United States Patent [19]

Perry

[11] 4,177,623

[45] Dec. 11, 1979

[54] STIRRUP STRAP FASTENER

[76] Inventor: Wayne W. Perry, 10641 W. 104th Pl., Broomfield, Colo. 80020

[21] Appl. No.: 888,369

[22] Filed: Mar. 20, 1978

[51] Int. Cl.[2] ..... A44B 11/22

[52] U.S. Cl. ..... 24/176; 54/46; 24/177

[58] Field of Search ..... 54/46, 44; 24/181, 176, 24/177

[56] References Cited

U.S. PATENT DOCUMENTS

| | | | |
|---|---|---|---|
| 2,567,314 | 9/1951 | Baker | 24/176 |
| 3,314,121 | 4/1967 | Blevins et al. | 24/181 |
| 3,638,395 | 2/1972 | Reidhead | 54/46 |

*Primary Examiner*—Hugh R. Chamblee

*Attorney, Agent, or Firm*—Richard D. Law

[57] ABSTRACT

A metal plate secured to a stirrup strap includes a pair of offset prongs for extending through spaced openings in a saddle strap, for fastening the stirrup strap to the saddle strap, and a central plate extension between the prongs prevents accidental removal of the fastener and aids the release of the fastener from the strap.

4 Claims, 7 Drawing Figures

STIRRUP STRAP FASTENER

This invention relates to fasteners for releasably securing a stirrup strap to a saddle strap, providing easily changed lengths of the stirrup straps for the saddle.

PRIOR ART

Since man's early history, horses have been used for transportation. For riding, saddles have been used, and many items of the saddle have been made adjustable. The length of the stirrups for the saddle is essential to the comfort and well-being of the rider. The adjustment of the stirrup straps have been accomplished by many buckles, straps, laces and the like. For example, U.S. Pat. No. 3,209,423 discloses a locking device for straps which includes a plate with two longitudinally aligned projections for fitting aligned holes in a second strap and sleeve which slides over the plate securing the plate in position with the projections in the holes of the second strap. A similar buckle for stirrup straps is shown in U.S. Pat. No. 3,314,121 with four projections on the plate arranged to fit in four holes in the other strap, with a sleeve encompassing the plate and holding the projections in the second strap. Each of these patents have the projections of a length (from the plate) that is approximately the same as the thickness of the second strap. Thus, the projections do not extend through the second strap but the projection ends are generally flush with the surface of the belt and buckle is useful for thick leather straps. The sleeve is, therefore, necessary to hold the projections in the strap and the plate in its position.

OBJECTS AND ADVANTAGES OF THE INVENTION

Included among the objects and advantages is to provide a simple, one piece buckle or locking means for releasably securing two leather straps together.

Another object is to provide a metal plate, to which one strap is permanently fastened, having offset, spaced apart prongs which pass through aligned holes in a second strap for securing the one strap to a second strap, with the prongs passing through strap, and in which the ends of the prongs lie along the opposite side of the strap while the plate lies along the other side.

Still another object of the invention is to provide a double pronged plate with a securing land between the two prongs, to hold the prongs in a pair of holes in a strap, and which land aids the removal of the prongs from the strap.

Yet another object of the invention is to provide a durable one piece fastener for stirrup straps which is easy to manufacture, and is used for quickly changing the length of connected straps.

These and other objects of the invention may be readily ascertained by reference to the following description and appended illustrations.

SPECIFIC DESCRIPTION OF THE DRAWINGS

Figure 1:
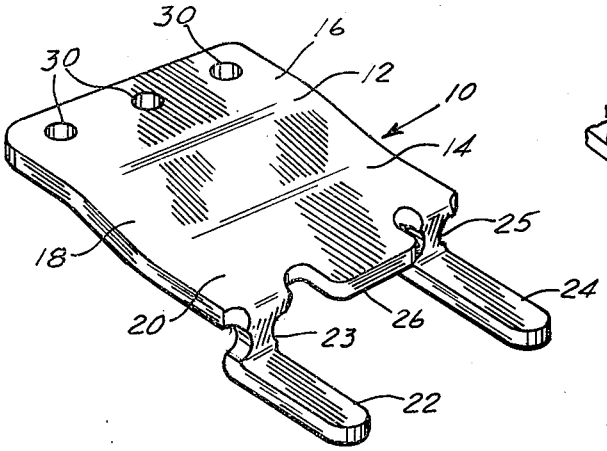
FIG. 1 is a perspective view of one form of the strap fastening means according to the invention.
Figure 2:
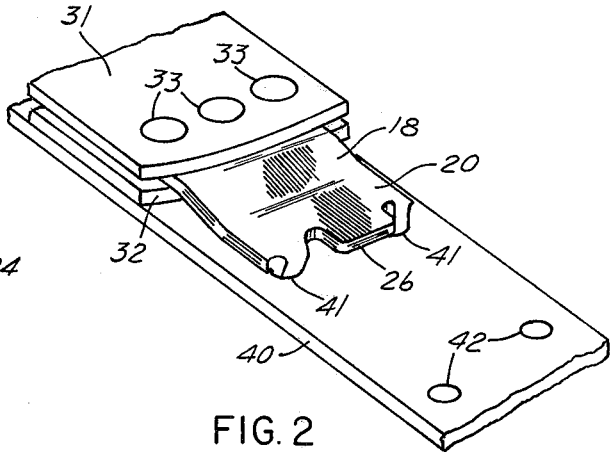
FIG. 2 is a perspective view of the fastening device of FIG. 1 secured to one strap, and releasably fastened to another strap.

In the device selected for illustration in the drawings, the fastening device is comprised of a metal plate, shown in general by numeral 10, which is of a general rectangular shape, and is broken to produce shallow bend lines 12 and 14 to produce a rectangular land which is generally planar, a sloped land 18, a land 20 which is parallel to, but offset from the land 16. A pair of prongs 22 and 24 connected respectively by bent portions 23 and 25 are secured to the land 20 and the outer ends are generally parallel to the plane of the land 20 but offset a distance determined by the neck portions 23 and 25. Depending from land 20, between the two prongs 22 and 24, is a land 26 which is an extension of the planar land 20, and it has an outer edge extending beyond the surfaces of the neck portions 23 and 25. A series of three holes 30 are formed through the land 16 to provide means for attachment of the fastener to a strap or a pair of straps (FIG. 2), wherein the fastener is secured between two leather straps 31 and 32 by means of countersunk, flush head rivets 33. The plane of the land 16 is offset from the plane of the land 20 a sufficient amount so that the bottom surface of the strap 32 approximately level with the bottom surface of the plane 20. This provides a face-to-face engagement of the strap 32 with a strap 40, when the prongs 22 and 24 are passed through holes 41 in the strap 40. In the position of FIG. 2, the prongs 22 and 24 lie in the plane of the bottom surface of the strap 40, and the o-fset neck portions 23 and 25 are of a sufficient length so that the prongs rest against the bottom surface of the strap 40 while the bottom surface of the land 20 lies against the top or upper surface of the strap 40. By having the prongs lying against the bottom surface and the land 20 and the land 26 lying on the upper surface, the fastener provides a secure hold for the fastener in the strap 40. The neck portions may be at 90° or more so as to be directed toward land 20.

Figure 4:
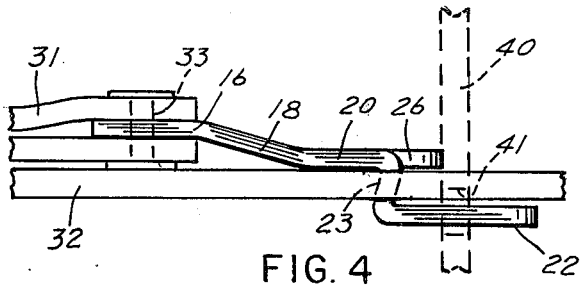
FIGS. 4, 5 and 6 are edge views of the fastening device of the invention in relation to straps.
Figure 5:
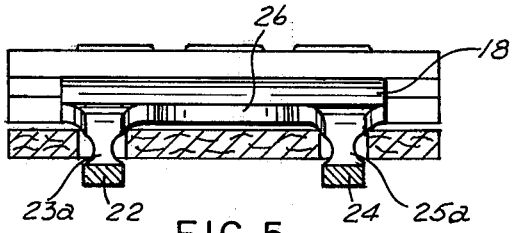

The projection 26 which extends beyond the neck portions 23 and 25 of the prongs prevents accidental removal of the prongs from the holes in the strap. The extension 26 provides a short land on the opposite side of the holes through which the prongs pass and it is in the plane of the land 20, so that both lie on the top surface of strap 40. This securely holds the prongs in position flush against the bottom surface of the strap 40. As shown in FIG. 4, the two connecting neck portions 23 and 25 may be bent back (toward land 20) at a slight angle (bent at more than 90°) to provide a still further secure means for holding the prongs in the holes of the strap. When it is desired to remove the prongs, the straps 31 and 32 are pulled to a right angle to the strap 40, so that the outer edge of the land 26 acts as a fulcrum pulling the neck back end of the prongs through the openings in the belt 41. This actually aids in the release of the prongs from the strap. The action is particularly valuable when the holes are undersized so that considerable pressure may be needed to force the prongs through the hole and in rotating the plate against the strap 40. The undersized holes insure that the land 20 lies on the surface of the strap on one side and the prongs lie on the surface of the opposite side. To aid in the holding and to prevent the holes from becoming enlarged, the lands 23 and 25 may be relieved, shown in FIG. 5 where the land 23*a* is relieved on both sides as is the land 25*a* to reduce the thickness of the metal at those points.

Figure 3:
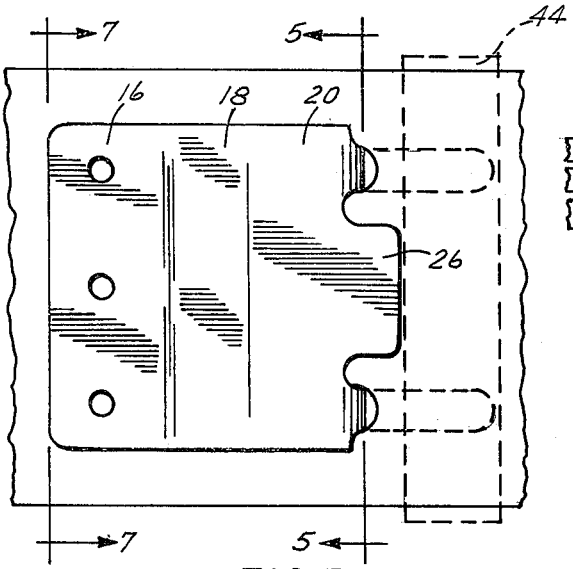
FIG. 3 is a plan view of the fastening device of FIG. 1.
Figure 6:
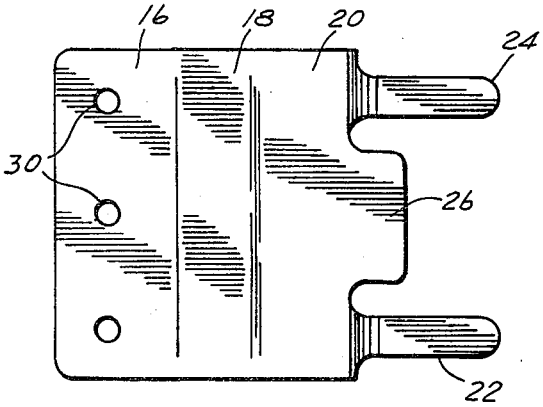
Figure 7:
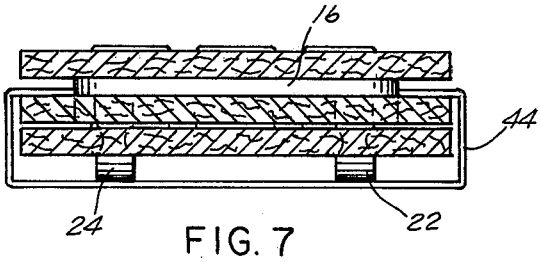
FIG. 7 is a bottom plan view of the fastening device.

In some instances it may be desirable to add a simple metal sleeve, FIGS. 3 and 7, when a sleeve 44 is a rectangular tube of metal having a sufficient opening to pass over the prongs when they are lying against the strap. The sleeve as shown in FIG. 6 bears on the surface of the strap 20 against the edge of land 26, and over the prongs on the back side to securely hold the prongs in position on the strap 40.

The fastening device of the invention is particularly useful for stirrup straps, where a length adjustment is highly desirable and may be frequently done, as, for example, in rodeos, riding stables and the like. In such a configuration, a stirrup is normally secured to the end of the straps 31 and 32 by the usual means, while the strap 40 is secured to the saddle. A plurality of spaced holes such as holes 41 and 42, as shown in FIG. 2, may be formed in the saddle strap along its length. This then provides for a length adjustment of the stirrup in relation to the saddle.

Other embodiments may be made in the concept of the fastening device of the invention and modifications may be obvious to those skilled in the art and it is intended that the matter herein described is merely illustrative of the invention and not limiting thereto except as defined in the following claims.

What is claimed is:

1. Fastener means releasably joining straps together comprising:

a metal plate having a pair of spaced bends to produce spaced apart, parallel, planar land areas offset from each other at least the thickness of the straps and spaced apart by a sloped land between the spaced lands, a first of said parallel areas having a plurality of holes for permanently securing said plate to strap means;

a pair of spaced apart prongs extending outwardly from the second said planar land area directed away from said first land area with said holes, and said prongs being offset from said second adjacent land area by neck portions of a length of the general thickness of a strap to be fastened, and outer planar ends of said prongs being generally parallel to said second land area; and a land extension parallel with and extending from said second land area between said spaced apart prongs, and extending beyond said neck portions and of a length substantially less than said prongs.

2. Fastener means according to claim 1 wherein said neck portions are bent at more than 90°, directed at a slight angle rearwardly toward said second land.

3. Fastener means according to claim 1 wherein said neck portions are of a length of approximately the thickness of the strap through which they are passed so that said extension land rests on one side of a strap and said prongs lie against the opposite side thereof.

4. Fastener means according to claim 1 wherein said neck portions are relieved to provide a thinner section residing in a hole in the strap in which it is placed.

* * * * *